United States Patent [19]

Coates et al.

[11] 4,419,936

[45] Dec. 13, 1983

[54] BALLISTIC PROJECTILE

[75] Inventors: Arthur D. Coates; William F. Donovan; John A. Rakaczky, all of Harford City, Md.; Wayman E. Scott, Knoxville, Tenn.

[73] Assignee: The United States of America as represented by the Secretary of the Army, Washington, D.C.

[21] Appl. No.: 408,317

[22] Filed: Aug. 16, 1982

Related U.S. Application Data

[62] Division of Ser. No. 139,372, Apr. 11, 1980, Pat. No. 4,383,485.

[51] Int. Cl.[3] ..... F42B 11/24

[52] U.S. Cl. ..... 102/364; 102/478; 102/501

[58] Field of Search ..... 102/340, 342, 351, 357, 102/364, 365, 367, 501, 502, 507–513, 517–519, 473, 477, 478

[56] References Cited

U.S. PATENT DOCUMENTS

| | | | |
|---|---|---|---|
| 3,429,263 | 2/1969 | Snyder et al. | 102/513 |
| 3,566,793 | 3/1971 | Kruzell | 102/518 |
| 3,616,758 | 2/1971 | Komarov | 102/512 |
| 3,677,182 | 7/1972 | Peterson | 102/517 |
| 4,096,804 | 6/1978 | Bilsbury | 102/364 |
| 4,318,343 | 3/1982 | King | 102/365 |

*Primary Examiner*—Harold J. Tudor

*Attorney, Agent, or Firm*—Robert P. Gibson; Anthony T. Lane; Max Yarmovsky

[57] ABSTRACT

The invention relates to a hermetically sealed ballistic projectile having a nose, material containing shell and a piston. The nose has a rearwardly increased diameter and a rearward region of decreased diameter, the shell has a forward most region of mating diameter with the rearward region of the nose and is in fixed but frangible contact with the nose. The piston is in hermetic sealed engagement with the inner surface of the forward region of the shell with its forward surface proximate the rearward surface of the nose. Material is used to fill the interior space of the shell between the piston and the rearward inner surface of the shell. The materials can be of a liquid, semi-liquid, slurry or solid consistency and are explosive, hypergolic, incendiary or otherwise reactive or inert, and contained in a single or a plurality of separate component containing compartments.

1 Claim, 14 Drawing Figures

FIG 1
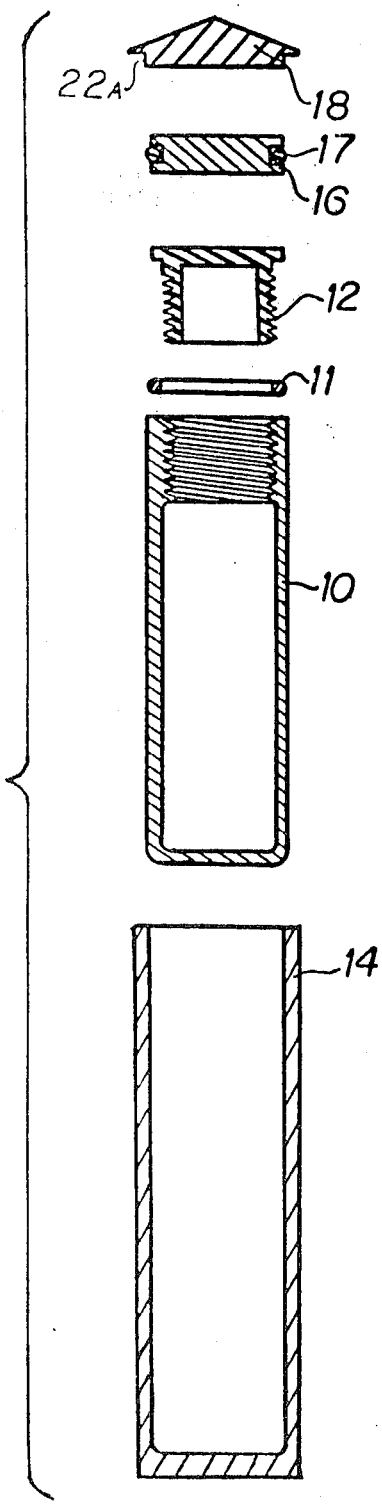
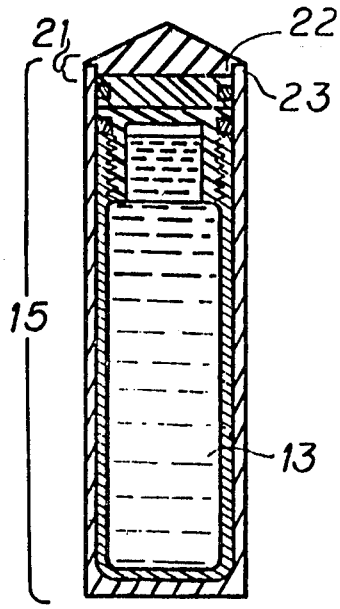
FIG 1A
FIG 1B
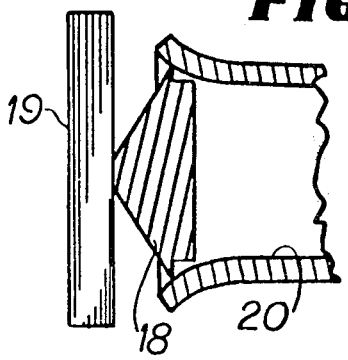
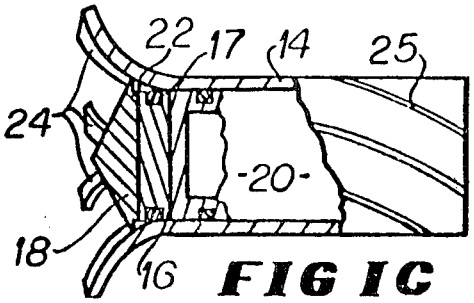
FIG 1C

BALLISTIC PROJECTILE

The invention described herein may be manufactured, used, and licensed by or for the Government for Governmental purposes without the payment to us of any royalties thereon.

This application is a division of application Ser. No. 139,372, filed Apr. 11, 1980 now U.S. Pat. No. 4,383,485.

BACKGROUND OF THE INVENTION

1. Field of the Invention

This invention relates to a projectile which contains flammable, corrosive, highly oxidizing or otherwise reactive materials.

2. Description of the Prior Art

The incendiary projectile devices of the prior art involve the following principal systems: (1) pyrophoric metal projectiles composed in part or entirely of a pyrophoric material such as iron-cerium alloys, zirconium, depleted uranium and similar other materials, employing the pyrophoric material as (a) the entire projectile, (b) entire composition of saboted projectile or (c) a structural component or adjunct to the previously noted uses, a or b above; (2) projectile or fragments containing magnesium-teflon compositions as incendiary projectiles; (3) high explosive-incendiary projectiles employing an incendiary material in the explosive matrix or as a separate composition located within or adjacent to the explosive fill of the projectile; (4) certain Armor Piercing Incendiary Tracer small arms rounds contain an exothermic metal incapsulated in a non-explosive organic binder, reacting when the incapsulated material positioned behind the ogive and in front of the armor piercing penetrator is effectively collapsed at a very high rate upon impact of the projectile on an armored target; (5) other incendiary projectiles make use of an exothermic metal or metal alloys thereof; e.g. Al or Al-Mg plus an oxidizer material, e.g. $KClO_4$, whereupon impact the heated exothermic metal reacts with oxygen from the heated $KClO_4$ and from the surrounding atmosphere. There exists several combinations of exothermic metal and oxygen bearing chemicals that are utilized for incendiary uses.

Current incendiary projectiles have limited effectiveness for the initiation of high explosives, giving a varied, unpredictable degree of effectiveness against "soft" military targets and frequently require a fuze assembly for effective functioning of the reactive components.

The projectile of the instant invention fills a need that exists in terminal ballistics applications. There are a number of highly reactive chemicals that ignite spontaneously in air or on contact with combustible organic materials, however, the ability to perform ballistic tests of the referenced chemicals as incendiary agents, ignition sources or promoters of combustion has been hampered by the lack of reliable gun fired projectiles. It is a complex task to devise a projectile to contain liquid or solid chemicals that are highly reactive, quite corrosive, and may be gaseous at room temperature. Also, the projectile must be safely stored for extended periods of time, then loaded safely into a gun and survive the high pressure launch environment of a spin stabilized flight at muzzle velocities in the range of 3800 to 4000 feet per second.

The instant projectile, as originally conceived in a 20 mm diameter projectile is designed to carry internally a liquid or solid reactant material payload. The projectile is a proven device and has been used successfully for several series of ballistic tests.

SUMMARY OF THE INVENTION

The disadvantages of the systems of the prior art are overcome through the use of a hermetically sealed ballistic projectile in which a nose of rearwardly increasing diameter and a rearward region of decreased diameter, a shell in which the forward most region is of mating diameter with the rearward region of the nose and in fixed but frangible contact with the nose, and a piston positioned between the two in hermetic sealed engagement with the inner surface of the forward region of the shell, forms an easy to store, effective projectile. The hollow portion of the shell is filled with materials which can be of a liquid, semi-liquid, slurry or solid consistency and are explosive, hypergolic, incendiary or otherwise reactive or inert, and contained in a single or a plurality of separately contained hypergol components.

BRIEF DESCRIPTION OF THE DRAWINGS

The objects and advantages of the invention will become apparent from the specification, particularly when read in conjunction with the drawings wherein:

FIG. 1 is an exploded cross-sectional view of a projectile in accordance with the present invention;

FIG. 1*a* is a cross-sectional side view of the assembled projectile of FIG. 1;

FIG. 1*b* is a cross-sectional fragmentary side view of the projectile of FIG. 1 impacting a target;

FIG. 1*c* illustrates the segmenting of the shell of the projectile of FIG. 1 during impact;

DETAILED DESCRIPTION OF THE EMBODIMENTS

Figure 2:
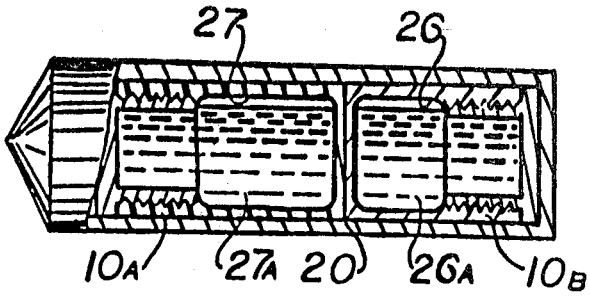
FIG. 2 is a partial cross-sectional side view of an alternate embodiment of the present invention.

FIG. 1 illustrates the instant invention in a non-assembled state with FIG. 1*a* showing the projectile completely assembled. The projectile consists essentially of two cylindrical sections, a light construction capsule or cylinder 10 and high strength metal, thin walled capsule or cylinder 14. The inner cylinder 10 is designed to carry the payload reactant material as well as the primary seal for the payload, and must be fabricated from a material that is compatible with the reactant fill to prevent leakage. Capsule 10 is hermetically sealed by washer 11 and can be threadable attached by closure 12 containing the pre-filled monometric fluid 13 within the capsule 10. The inner capsule 10 is then in turn contained within the outer capsule 14. As stated, the outer capsule 14 employs a high strength metal configured in a thin wall design in order to maximize the volume of reactant payload while providing adequate strength to survive the high pressures and acceleration that occur in gun launch environments.

Positioned above the loaded and sealed inner cylinder is a metal piston containing the redundant seal and sealable vent for positioning the metal piston. Subsequently, the selected geometry nose or ogive section is fitted into the annular opening of the exterior section.

The inner capsule 10 and outer capsule 14 are hermetically sealed from contamination of any nature by washer 11, piston 16, "O" ring 17 and nose 18. Nose 18 may be of any particular target characteristic to insure dispersal of the reactant payload upon contact and fracture of the capsule at the target.

The closure 12 may be attached to the inner capsule 10 by other manufacturing means; i.e. ultrasonic welding, shrink/interference fit, etc., providing that a positive seal is included in the construction and that the closing technique neither contaminates nor activates the reactant.

FIG. 1A shows joint 21 as a shoulder engagement (rabbet fit) where a shoulder or stepped diameter 22 male region is machined into the nose 18 and the mating diameter 23 female region is part of the shell body 14. The shoulder 22A slidably aligns the nose with the shell cavity surface. FIG. 1B shows the relative position of elements upon contact with the target 19. The nose 18 is driven into the cylindrical body cavity 20 by virtue of the kinetic energy of the entire projectile 15 and the differential mass of the nose 18 as compared to the remaining elements and the deliberately contrived expanding joint 21, to be weak in the axial direction. FIG. 1C, illustrates, from a relatively rearward position, the movement of the nose 18 into the body cavity 20 which occurs as a result of mechanical failure of the joint 21 and the radial/circumferential yielding of the cavity wall. This yielding or fracture results from the rearward movement of the nose 18 acting on the piston 16. The "O" ring 17 which is mounted on the piston 16 and is slidable within the body cavity 20 and presses on the capsule 10 thereby compressing the fluid 13. The compression of the fluid 13 in combination with the high rate rotation of the projectile, produces shards 24 along the local indentations or scores 25 which have been previously impressed on the outer capsule 14 by the rifling of the launch tube. Further movement of the nose 18 acting as an activating mechanism for the piston 16, causes the liquid 13 contained in the inner capsule 10 to be spewed in a helical pattern in the immediate vicinity of the target. The distribution of the liquid 13 is continuous until the liquid has been expanded while the residual kinetic energy of the solid parts causes the projectile itself to be scattered in the target area. The continuous liquid ejection insures that a minimal quantity of reactive liquid is expended in defeating the protective barriers. This follows from a determination of the elapsed time in transit, which will be inversely proportional to the velocity which the disintegrating projectile spends in each elemental volume of material. The velocity is very high (and the residence time very low) when the first contact is made and the velocity decreases (the residence time increases) as the projectile proceeds through the projectile medium. Ideally, the projectile would have zero velocity when finally embedded in the explosive. For a known target, the timed issuance of the liquid is controllable by the design of the volume of the liquid, the available kinetic energy at the target and the respective momenta of the component parts of the projectile and the predictable resistance of the fore-target materials.

FIG. 2 illustrates the construction of a single container for delivery of hypergolic fluids. One inner capsule 10 contains two separate cavities, 26 and 27. One hypergol 26A, (unsymmetrical dimethyl hydrazine for example), would be contained in cavity 26 while a second hypergol 27A ($HNO_3$) would be contained in cavity 27. The two cavities 26 and 27 must be isolated to prevent the mixing of the hypergols until impact of the projectile. The operation at the target is as previously described except that the fracture of the capsules and contact of the hypergols produces a strong chemical reaction, predictable according to the character of the hypergols and subsequent combined and/or target materials secondary reactions. The mechanical arrangement of the capsules containing the cavities 26 and 27 may be in tandem or axially nested to conform to manufacturing requirements and need not be limited to two cavities.

Figure 3A:
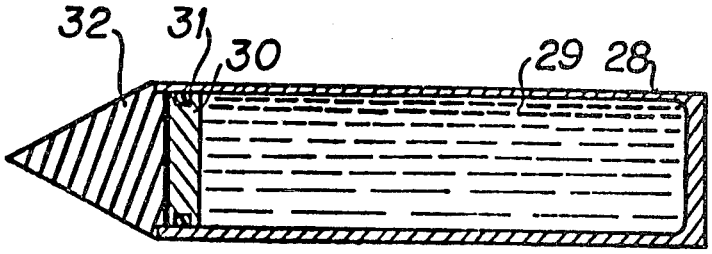
FIG. 3*a* is a cross-sectional side view of an additional embodiment of the present invention.
Figure 3B:
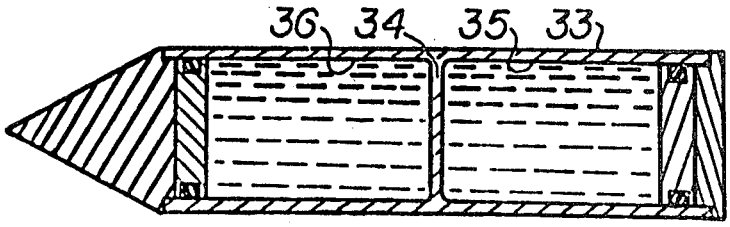
FIG. 3*b* is a cross-sectional side view of another embodiment of the present invention.
Figure 3C:
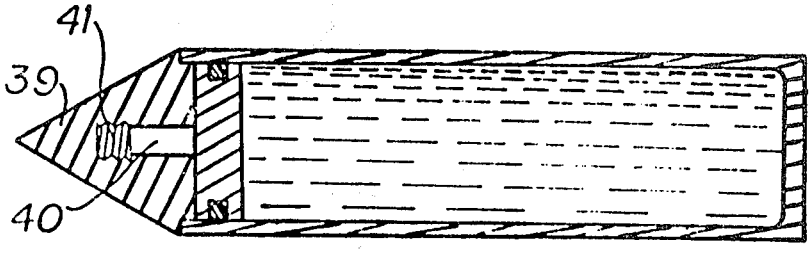
FIG. 3*c* is a cross-sectional side view of the present invention containing a fuse cavity in the nose.
Figure 3D:
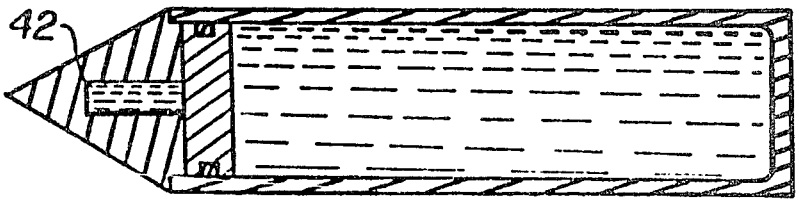
FIG. 3*d* is an alternate cross-sectional view of the nose of FIG. 3*c* allowing for hypergol to to be carried.
Figure 3E:
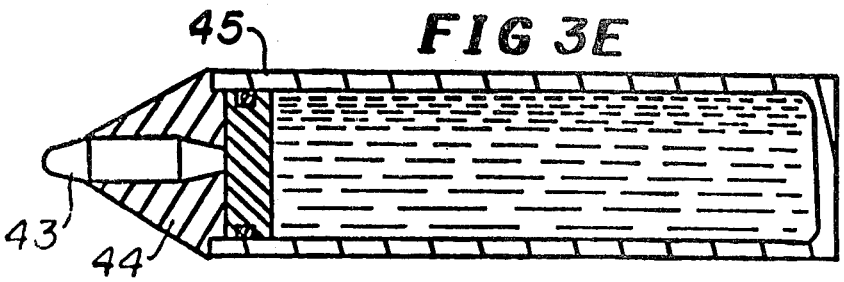
FIG. 3*e* is another alternate cross-sectional view of the nose of FIG. 3*c* containing a kinetic energy penetrator.

FIG. 3A illustrates an alternate embodiment to the invention employing an integral construction monometric fluid design. The canister-shell body 28 is formed as a capsule similar to capsule 14 in the previously described embodiments. The fluid 29 is confined within the capsule 28 by piston 30, which is used with an "O" ring 31 in proximity to the nose 32 which is fitted into the canister-shell body 28 by an axially weak rabbet fit joint as previously described. The results upon contact are previously described with the one obvious difference in that only one capsule is being used. FIG. 3B shows the corresponding construction for a hypergolic fluid arrangement. The double canister-shell body 33 is manufactured with an integral membrane 34 transverse to the axis and forming cavities 35 and 36. Closure of this embodiment is as previously described with the other embodiments. FIG. 3C is a configuration similar to the previously described except that the nose 39 contains a cavity 40 for a conventional fuse 41. FIG. 3D is identical to the above except for the allowance for additional hypergol 42 to be carried in the nose 39 rather than the above noted fuse 41. Target operation is as previously described for the hypergol while the fuse function operation is well known in the prior art. FIG. 3E illustrates the application utilizing a kinetic energy penetrator 43 mounted in the nose 44. The fluid canister 45 aft end is optionally of monometric of hypergolic capability. The action of the penetrator at the target is to open armor, or the like, to the dispersal of the fluid reactants.

Figure 4A:
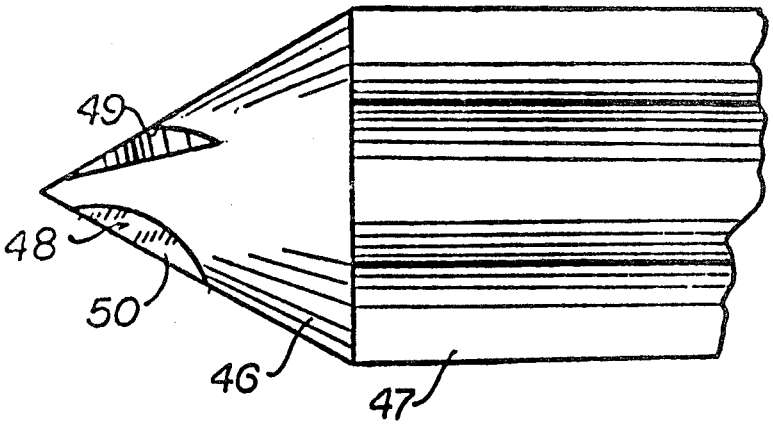
FIG. 4*a* is a side view, partly in cross-section, of another embodiment of the present invention.
Figure 4C:
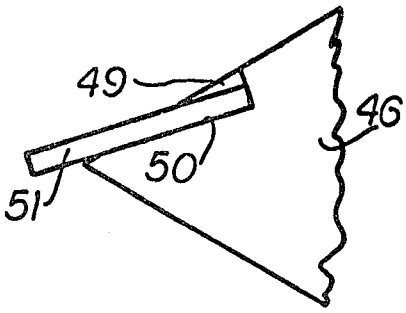
FIG. 4*c* is a plan view, illustrating the formation of the spin inducing means in the nose of a projectile.
Figure 4B:
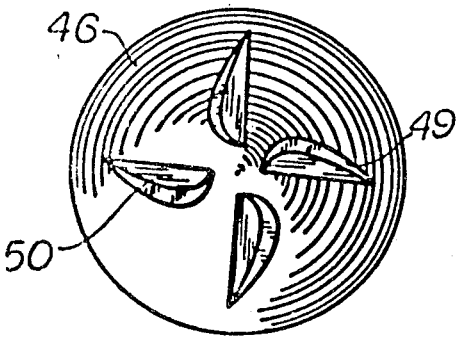
FIG. 4*b* is a front view of the projectile of FIG. 4.
Figure 4D:
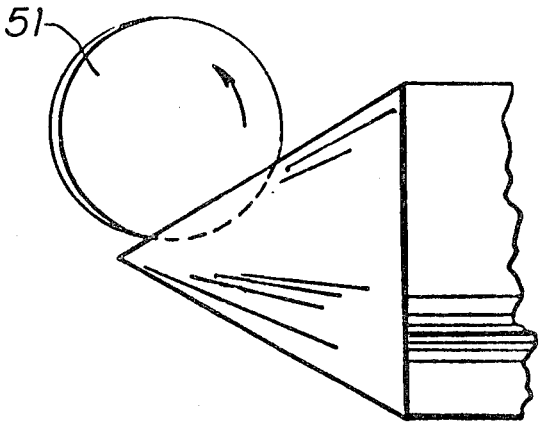
FIG. 4*d* is a side view of the formation of the pseudo-varied flow passages.

FIGS. 4A, and 4B show a unique nose designed to defeat pretarget material such as packed earth and to attack liquid targets such as stored oil in containers. The nose 46 contains preferentially milled, or otherwise formed, recesses 48 along its outer surface which may be optionally skewed with respect to the axis but ideally would be of modified helical development. These recesses 48 are distributed in axial symmetry. They are formed with one surface 49 designed to impart a radial velocity to the fluid or solid particles. This is the manner of a mixed flow pump deriving its rotating power from the available change in kinetic energy of the rotating mass and essentially "drilling" thru the protective screens. Operation of the active fluids at target is as previously described. FIG. 4C shows the milling operation with surfaces 49 and 50 formed by the advance of a peripheral milling cutter 51 into the nose 46 of the projectile. FIG. 4D shows a side view of the milling operation.

It should be noted that the projectile of the instant invention has been tested against high explosive filled targets. The projectiles fired contained various hypergolic and highly reactive oxidizing materials that caused spontaneous ignition of flammable organic compounds, e.g. high explosives. The reactive fillers tested in the instant projectile are triethylaluminum, white phosphorous, bromine trifluoride, bromine pentafluoride and a 50%–50% mixture of bromine trifluoride and chlorine trifluoride.

The initial embodiment of FIG. 1, the blunt nose projectile, was the projectile incorporated in the initial research and was test fired on many occasions without malfunction. Each of the test projectiles carried a full load of reactive material, each with the respective gasket material for primary seal of the selected reactant material.

The exterior steel case of all embodiments of the instant projectile is scored as it travels across the lands of the traditional twist gun barrel. Upon impact, the projectile fragments selectively in longitudinal strips approximately the widths of the lands and grooves of the twist gun barrel. This action increases the damage inflicted on "soft targets", i.e., unarmored targets. The fragmentation plus incendiary or pyrophoric action increases the lethality of this type of projectile.

The projectile of the instant invention may be used in a series of calibers, with liquid, semi-liquid, slurry or solid materials that are explosive, hypergolic, incendiary or otherwise reactive or inert. The criticality of the invention lies in the combination of design, redundant hermetic seals, multiplicity of cargo materials, anti-explosive application and accurate ballistic trajectory and therefore cannot be limited within the application by the caliber, nose configuration or reactants specifically listed in the instant application.

We claim:

1. A hermetically sealed ballistic projectile comprising:

a nose member having a rearwardly increasing diameter and a rearward region of decreased diameter, a rearward surface, and an axial countersunk-bore therethrough which includes;

a kinetic energy penetrator axially disposed in said countersunk-bore and protruding from said nose member to form a leading point of impact of said projectile;

a shell member a rearward inner surface and interior space, a forward most region having an inner surface of mating diameter with said nose member rearward region of decreased diameter and being in fixed but frangible contact with said nose member which includes an exterior steel case which is helically scored when it travels through a gun barrel and fragments in longitudinal strips upon impact;

a piston member having a forward most surface proximate the rearward surface of said of said nose member, said piston member being in hermetically sealed engagement with the inner surface of the forward most region of said shell member; and a hypergolic fluid filling the interior space of said shell member between said rearward surface of said piston member and the rearward inner surface of said shell;

whereby on impact of said projectile with a target said kinetic energy penetrator penetrates said target and said nose member moves rearwardly fracturing said shell along said indentations and forces said piston member rearwardly causing said hypergolic fluid to be spewed in a helical pattern in the immediate vicinity of the target.

* * * * *